US012458064B2

(12) United States Patent
Paprocki

(10) Patent No.: US 12,458,064 B2
(45) Date of Patent: Nov. 4, 2025

(54) APPARATUS FOR HEATING AN ARTICLE INCLUDING AN AEROSOLIZABLE MEDIUM, A METHOD OF MANUFACTURING THE APPARATUS AND AN AEROSOLIZABLE MATERIAL ARTICLE FOR USE WITH THE APPARATUS

(71) Applicant: NICOVENTURES TRADING LIMITED, London (GB)

(72) Inventor: Benjamin Paprocki, Cottage Grove, WI (US)

(73) Assignee: NICOVENTURES TRADING LIMITED, London (GB)

( * ) Notice: Subject to any disclaimer, the term of this patent is extended or adjusted under 35 U.S.C. 154(b) by 0 days.

(21) Appl. No.: 17/250,637

(22) PCT Filed: Aug. 12, 2019

(86) PCT No.: PCT/EP2019/071605

§ 371 (c)(1),
(2) Date: Feb. 15, 2021

(87) PCT Pub. No.: WO2020/035454

PCT Pub. Date: Feb. 20, 2020

(65) Prior Publication Data

US 2021/0212366 A1 Jul. 15, 2021

Related U.S. Application Data

(60) Provisional application No. 62/764,747, filed on Aug. 15, 2018.

(51) Int. Cl.
*A24F 40/40* (2020.01)
*A24F 40/20* (2020.01)
(Continued)

(52) U.S. Cl.
CPC ..... *A24F 40/40* (2020.01); *A24F 40/20* (2020.01); *A24F 40/46* (2020.01); *A24F 40/70* (2020.01)

(58) Field of Classification Search
CPC ..... A24F 40/40; A24F 40/70; A24F 40/42; A24F 40/44; A24F 40/46; A24F 40/465; A24F 40/48; A24F 40/485
See application file for complete search history.

(56) References Cited

U.S. PATENT DOCUMENTS

2015/0128970 A1* 5/2015 Liu ..... A24F 40/485 131/329
2016/0366725 A1* 12/2016 Tucker ..... H05B 3/12
(Continued)

FOREIGN PATENT DOCUMENTS

CN 104522891 A 4/2015
CN 105142442 A 12/2015
(Continued)

OTHER PUBLICATIONS

International Search Report and Written Opinion, International Application No. PCT/EP2019/071605, mailing date Dec. 12, 2019, 3 pages.
(Continued)

*Primary Examiner* — John J Norton
*Assistant Examiner* — Dilnessa B Belay
(74) *Attorney, Agent, or Firm* — Merchant & Gould P.C.

(57) ABSTRACT

An apparatus for heating an article including an aerosolizable medium has a heating chamber for receiving the article; and a sleeve located around the heating chamber. The heating chamber and the sleeve define a region therebetween, and the sleeve is configured to receive a first seal at a first end of the sleeve and a second seal at a second end of the sleeve, so that the sleeve can engage with additional
(Continued)

components at the first and second ends in such a way that ingress or egress of fluid into or out of the region between the heating chamber and the sleeve is prevented.

25 Claims, 8 Drawing Sheets

(51) Int. Cl.
*A24F 40/46* (2020.01)
*A24F 40/70* (2020.01)

(56) References Cited

U.S. PATENT DOCUMENTS

| | | | | |
|---|---|---|---|---|
| 2017/0006916 | A1 | 1/2017 | Liu | |
| 2017/0055583 | A1 | 3/2017 | Blandino et al. | |
| 2020/0107572 | A1 * | 4/2020 | Marques Borges | .... A24F 40/46 |

FOREIGN PATENT DOCUMENTS

| | | | | |
|---|---|---|---|---|
| DE | 102014207154 | A1 | 10/2015 | |
| JP | H08511176 | A | 11/1996 | |
| JP | 2016534730 | A | 11/2016 | |
| JP | 2018504918 | A | 2/2018 | |
| RU | 2564611 | C1 | 10/2015 | |
| WO | WO-2017194766 | A1 * | 11/2017 | ..... A24F 40/20 |

OTHER PUBLICATIONS

International Preliminary Report on Patentability received for PCT Patent Application No. PCT/EP2019/071605, mailed on Feb. 25, 2021, 9 pages.

JP Office Action in JP Appln. No. 2021506645, dated Sep. 5, 2023, 7 pages.

* cited by examiner

APPARATUS FOR HEATING AN ARTICLE INCLUDING AN AEROSOLIZABLE MEDIUM, A METHOD OF MANUFACTURING THE APPARATUS AND AN AEROSOLIZABLE MATERIAL ARTICLE FOR USE WITH THE APPARATUS

CROSS-REFERENCE TO RELATED APPLICATIONS

The present application is a National Phase entry of PCT Application No. PCT/EP2019/071605, filed Aug. 12, 2019, which claims priority from Provisional Patent Application No. 62/764,747 filed Aug. 15, 2018, each of which is fully incorporated herein by reference.

TECHNICAL FIELD

The present invention relates to an apparatus for heating an article including an aerosolizable medium, a method of manufacturing an apparatus for heating an aerosolizable material article and an article of aerosolizable material.

BACKGROUND

Articles such as cigarettes, cigars and the like burn tobacco during use to create tobacco smoke. Attempts have been made to provide alternatives to these articles by creating products that release compounds without combusting. Examples of such products are so-called "heat not burn" products, also known as tobacco heating products or tobacco heating apparatus, which release compounds by heating, but not burning, material. The material may be for example tobacco or other non-tobacco products or a combination, such as a blended mix, which may or may not contain nicotine.

SUMMARY

In accordance with some embodiments described herein, there is provided an apparatus for heating an article including an aerosolizable medium, the apparatus comprising a heating chamber for receiving said article and a sleeve located around the heating chamber, wherein the heating chamber and the sleeve define a region therebetween, wherein the sleeve is configured to receive a first seal at a first end of the sleeve and a second seal at a second end of the sleeve, so that the sleeve can engage with additional components at the first and second ends in such a way that ingress or egress of fluid into or out of the region between the heating chamber and the sleeve is prevented.

In accordance with some embodiments described herein, there is provided a method of manufacturing an apparatus for heating an aerosolizable material article comprising providing a heating chamber and providing a sleeve around the heating chamber, the sleeve comprising a first end and a second end, wherein the heating chamber and the sleeve define a region therebetween, wherein the sleeve is configured to receive a first seal at the first end of the sleeve and a second seal at the second end of the sleeve, so that the sleeve can engage with additional components at the first and second ends in such a way that ingress or egress of fluid into or out of the region between the heating chamber and the sleeve is prevented.

Further features and advantages of the invention will become apparent from the following description of preferred embodiments of the invention, given by way of example only, which is made with reference to the accompanying drawings.

DETAILED DESCRIPTION OF THE DRAWINGS

As used herein, the terms "aerosolizable medium" includes materials that provide volatilized components upon heating, typically in the form of an aerosol. "Aerosolizable medium" includes any tobacco-containing material and may, for example, include one or more of tobacco, tobacco derivatives, expanded tobacco, reconstituted tobacco or tobacco substitutes. "Aerosolizable medium" also may include other, non-tobacco, products, which, depending on the product, may or may not contain nicotine. "Aerosolizable medium" may for example be in the form of a solid, a liquid, a gel or a wax or the like. "Aerosolizable medium" may for example also be a combination or a blend of materials.

Apparatus are known that heat an aerosolizable medium to volatilize at least one component of the aerosolizable medium, typically to form an aerosol which can be inhaled, without burning or combusting the aerosolizable medium. Such apparatus is sometimes described as a "heat-not-burn" apparatus or a "tobacco heating product" or "tobacco heating device" or similar. Similarly, there are also so-called e-cigarette devices, which typically vaporize an aerosolizable medium in the form of a liquid, which may or may not contain nicotine. The aerosolizable medium may be in the form of or provided as part of a rod, cartridge or cassette or the like which can be inserted into the apparatus. A heater for heating and volatilizing the aerosolizable medium may be provided as a "permanent" part of the apparatus or may be provided as part of the consumable which is discarded and replaced after use.

Figure 1:
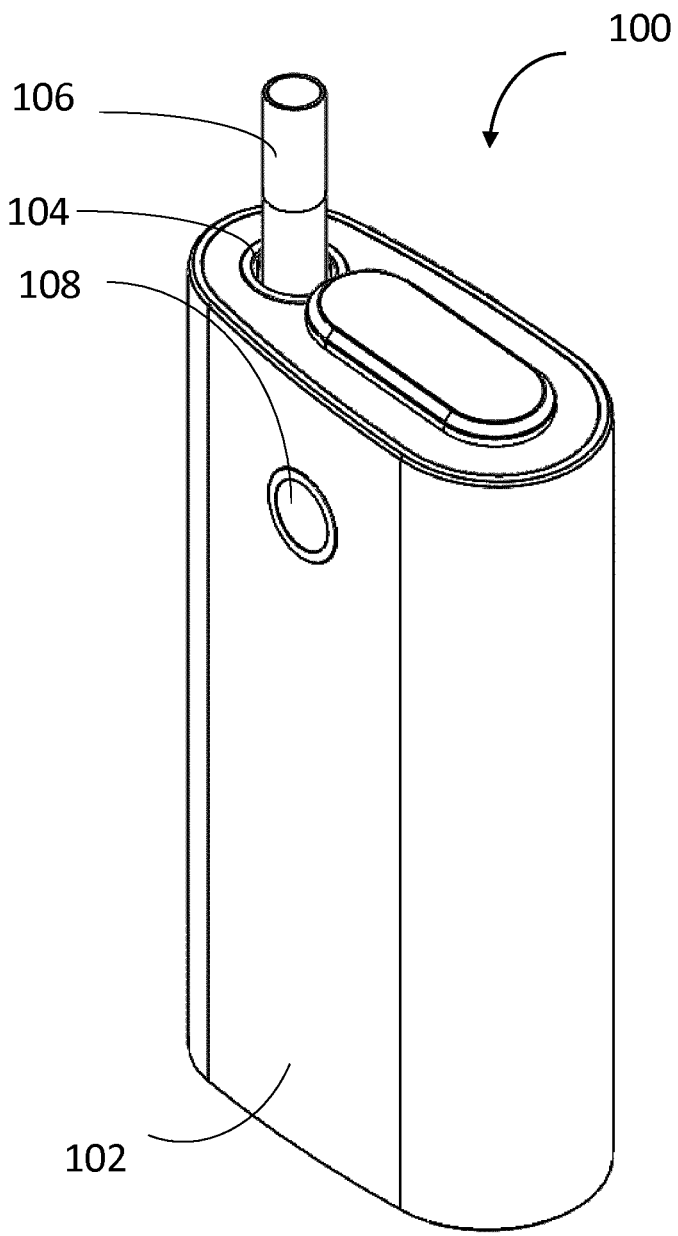
FIG. 1 shows a perspective view of an example of a device for heating an article comprising aerosolizable medium.

FIG. 1 shows an example of a device 100 for heating an article 106 comprising an aerosolizable medium. The device comprises a housing 102 including an opening 104 through which an article 106 comprising an aerosolizable medium may be inserted into a heating chamber 201 (not shown). The heating chamber is heated by one or more heating elements. The device 100 may include a user-operable button 108 that activates the device when pressed. The device 100 also includes an electronics compartment (not shown) that houses control circuitry and/or a power supply, such as a battery. The control circuitry may include a controller, such as a microprocessor arrangement, configured and arranged to control the heating of the aerosolizable medium as discussed further below. The power source may be, for example, a battery, such as a rechargeable battery or a non-rechargeable battery. Examples of suitable batteries include, for example, a lithium-ion battery, a nickel battery (such as a nickel-cadmium battery), an alkaline battery and/or the like. The battery is electrically coupled to the one or more heating elements to supply electrical power when required and under control of the control circuitry to heat the aerosolizable medium without causing the aerosolizable medium to combust. An advantage of locating the power source laterally adjacent to the one or more heating elements, rather than in series therewith, is that a physically large power source may be used without causing the device 100 as a whole to be unduly lengthy. As will be understood, in general, a physically large power source has a higher capacity (that is, the total electrical energy that can be supplied, often measured in Amp-hours or the like) and thus the battery life for the device 100 can be longer.

It has been found that an important requirement for the device 100 is for airflow through the heating chamber to be sealed or substantially isolated from the remainder of the device 100, in particular the electronics compartment. This is to prevent or at least minimize contamination of the control circuitry and/or power supply in the electronics compartment by aerosol, which may interfere with the operation of the device 100. It also prevents air from the control circuitry and/or a power supply in the electronics compartment from flowing into the heating chamber and interfering with the airflow.

Figure 2:
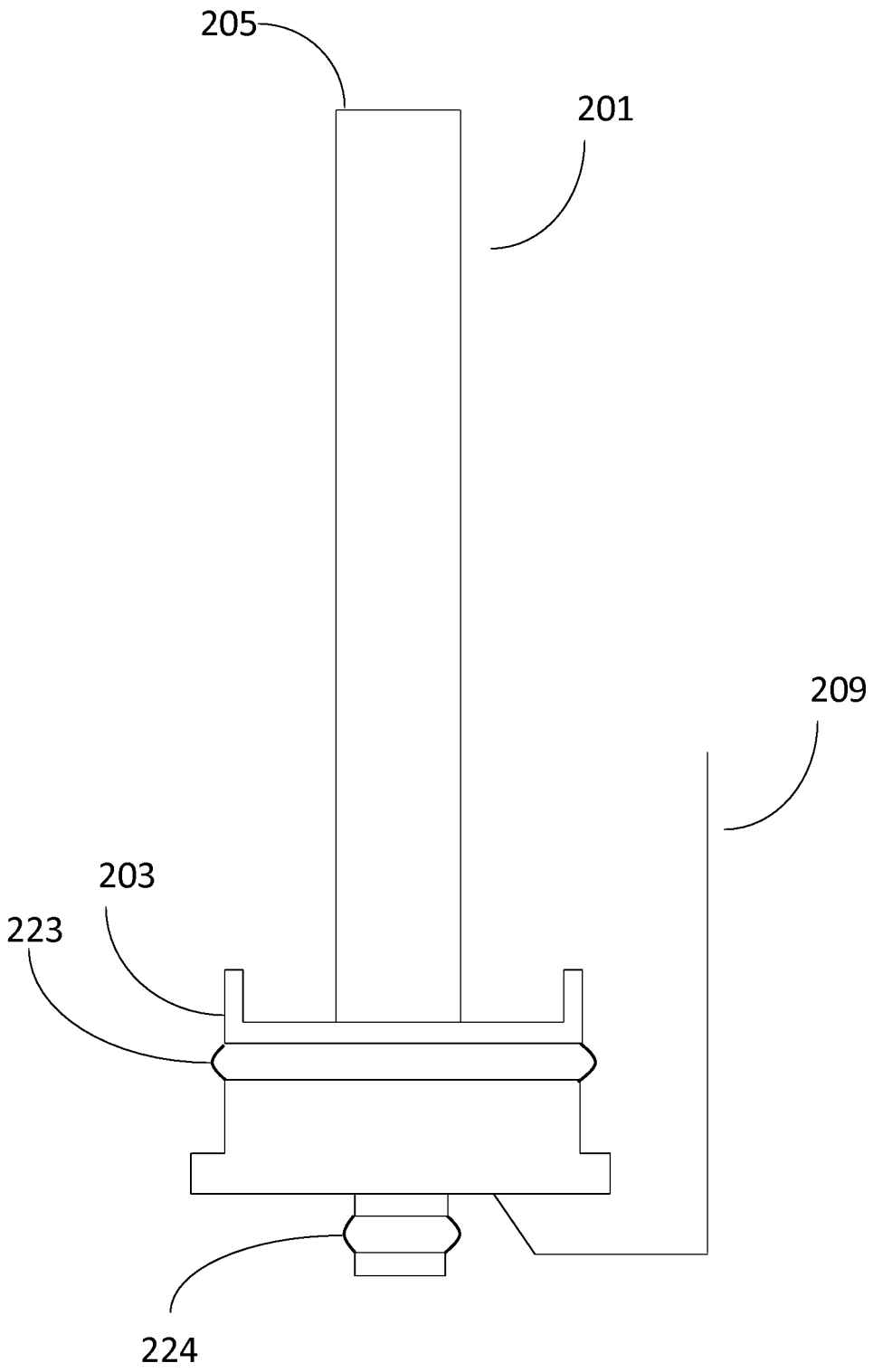
FIG. 2 shows a side view of an example of a heating chamber and a base that may form part of an apparatus for heating an aerosolizable medium.

FIG. 2 shows an example of a heating chamber 201 and a base 203 that may form part of an apparatus 300 for heating an aerosolizable medium. The heating chamber 201 has a first opening 205 at a first end for receiving an article 106 of aerosolizable medium (not shown). The heating chamber 201 also includes a second opening (not shown) at the second end of the heating chamber 201. In the example shown in FIG. 2, the second opening of the heating chamber 201 is located on the base 203.

In one example, the heating chamber 201 is generally in the form of a hollow cylindrical tube into which an article 106 comprising an aerosolizable medium is inserted for heating in use. Different arrangements for the heating chamber 201 are possible. The heating chamber 201 is heated by one or more heating elements. In one example, the one or more heating elements are resistive heating elements that heat up when an electric current is applied to them. In other examples, the one or more heating elements may comprise a susceptor material that is heated via induction heating. In this example, the device also includes one or more induction coils which generate a varying magnetic field that penetrate the one or more heating elements. Induction heating is a process in which an electrically-conductive object is heated by penetrating the object with a varying magnetic field. The process is described by Faraday's law of induction and Ohm's law. An induction heater may comprise an electromagnet and a device for passing a varying electrical current, such as an alternating current, through the electromagnet. When the electromagnet and the object to be heated are suitably relatively positioned so that the resultant varying magnetic field produced by the electromagnet penetrates the object, one or more eddy currents are generated inside the object. The object has a resistance to the flow of electrical currents. Therefore, when such eddy currents are generated in the object, their flow against the electrical resistance of the object causes the object to be heated. This process is called Joule, ohmic, or resistive heating. An object that is capable of being inductively heated is known as a susceptor. Magnetic hysteresis heating is a process in which an object made of a magnetic material is heated by penetrating the object with a varying magnetic field. A magnetic material can be considered to comprise many atomic-scale magnets, or magnetic dipoles. When a magnetic field penetrates such material, the magnetic dipoles align with the magnetic field. Therefore, when a varying magnetic field, such as an alternating magnetic field, for example as produced by an electromagnet, penetrates the magnetic material, the orientation of the magnetic dipoles changes with the varying applied magnetic field. Such magnetic dipole reorientation causes heat to be generated in the magnetic material. When an object is both electrically-conductive and magnetic, penetrating the object with a varying magnetic field can cause both Joule heating and magnetic hysteresis heating in the object. Moreover, the use of magnetic material can strengthen the magnetic field, which can intensify the Joule and magnetic hysteresis heating. In each of the above processes, as heat is generated inside the object itself, rather than by an external heat source, and is transferred by heat conduction, convection or radiation, a rapid temperature rise in the object and more uniform heat distribution can be achieved, particularly through selection of suitable object material and geometry, and suitable varying of magnetic field magnitude and orientation relative to the object. Moreover, as induction heating and magnetic hysteresis heating do not require a physical connection to be provided between the source of the varying magnetic field and the object, design freedom and control over the heating profile may be greater, and cost may be lower.

The one or more heating elements may be located internally of the heating chamber 201 or externally of the heating chamber 201. In one example, the one or more heating elements may comprise a thin film heater that is wrapped around an external surface of the heating chamber 201. For example, the heating element may be formed as a single heater or may be formed of a plurality of heaters aligned along the longitudinal axis of the heating chamber 201. The heating chamber 201 may be annular or tubular, or at least part-annular or part-tubular around its circumference.

In one particular example, the heating chamber 201 is defined by a stainless steel tube. The heating chamber 201 is dimensioned so that substantially the whole of the aerosolizable medium in the article 106 is located within the heating chamber 201, in use, so that substantially the whole of the aerosolizable medium may be heated. The heating chamber 201 may be arranged so that selected zones of the aerosolizable medium can be independently heated, for example in turn (over time) or together (simultaneously), as desired.

In one example, part of the one or more heating elements, such as a heater tail 209, extends beyond the heating chamber 201 and is configured to connect the heating element to control circuitry and a power source in an electronics compartment. An electrical current may be provided by the power source to the one or more heating elements via the control circuitry and the heater tail 209. In one example, the heater tail 209 is connected to a printed circuit board (PCB). As a connection between the heating chamber 201 and the electronics compartment is required, it can be difficult to prevent airflow (or the flow of any other fluids) between the heating chamber 201 and the electronics compartment, but the extension of the heater tail 209 beyond the heating chamber 201 assists with addressing this.

Figure 3:
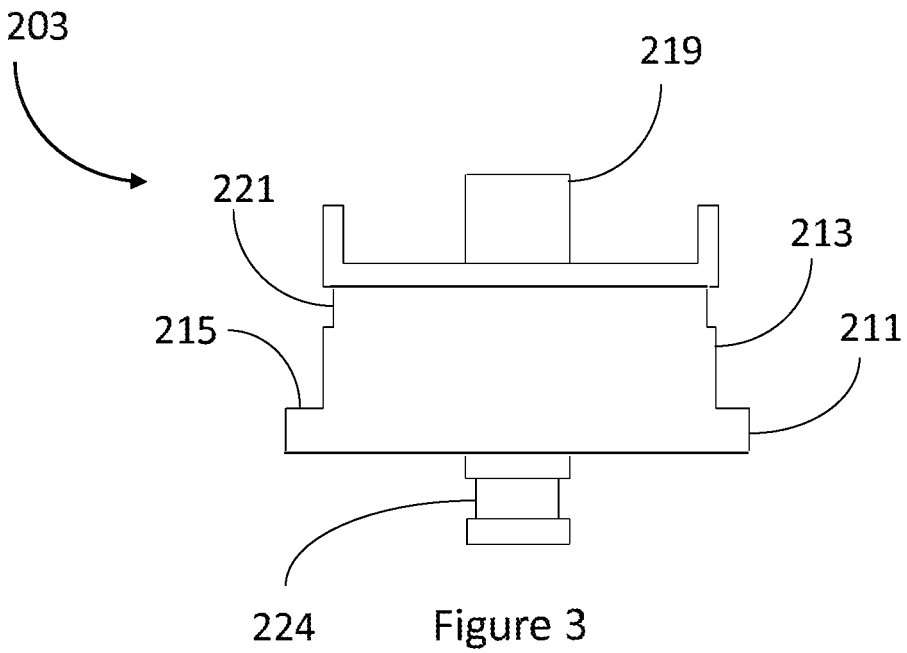
FIG. 3 shows a side view of an example of a base that may form part of an apparatus for heating an article comprising aerosolizable medium.

FIG. 3 shows an example of a base 203 that may form part of the apparatus 100 for heating an article 106 including an aerosolizable medium. The heating chamber 201 is not shown in FIG. 3. The base 203 includes a main body portion 211 and a first projection or protuberance 213 that projects from a central portion of the main body portion 211. In one example the first protuberance 213 has a smaller diameter or width compared with the corresponding diameter or width of the main body portion 211. The difference in diameter or width between the first protuberance 213 and the main body portion 211 creates a lip, rim or flange 215 around the first protuberance 213. The body 203 may also include a second protuberance or projection 219 that also projects from the surface of the main body portion 211. In the example shown, the second protuberance 219 is located towards the center of the base 203, preferably substantially centrally of the main body portion 211. The second protuberance 219 may project into, or be inserted into the second opening of the heating chamber 201, and acts to position or locate the heating chamber 201 on the base 203. The second protuberance 219 may also act as a stop for the article 106 when it is inserted into the heating chamber 201. The first protuberance 213 on the base 203 includes a recess 221 in which a first seal 223 may be located, as shown in FIG. 2. Alternatively, the first seal 223 may be located around the main body portion 211 so that it rests against the flange 215. The base 203 may also include a connection element 224 that connects to the housing 108 of the device. The connection element 224 may be received in a corresponding opening within the housing 108 of the device. The connection element 224 may include a recess for receiving a seal, such as an O-ring, which seals the connection element 224 to the housing 108. In one example, the O-ring is made of silicone. However, any other suitable material could also be used.

In the example shown in FIG. 3, the main body portion 211, the first protuberance 213 and the second protuberance 219 all have circular or ring-shaped cross-sections. However, other shapes may be used.

Figure 4:
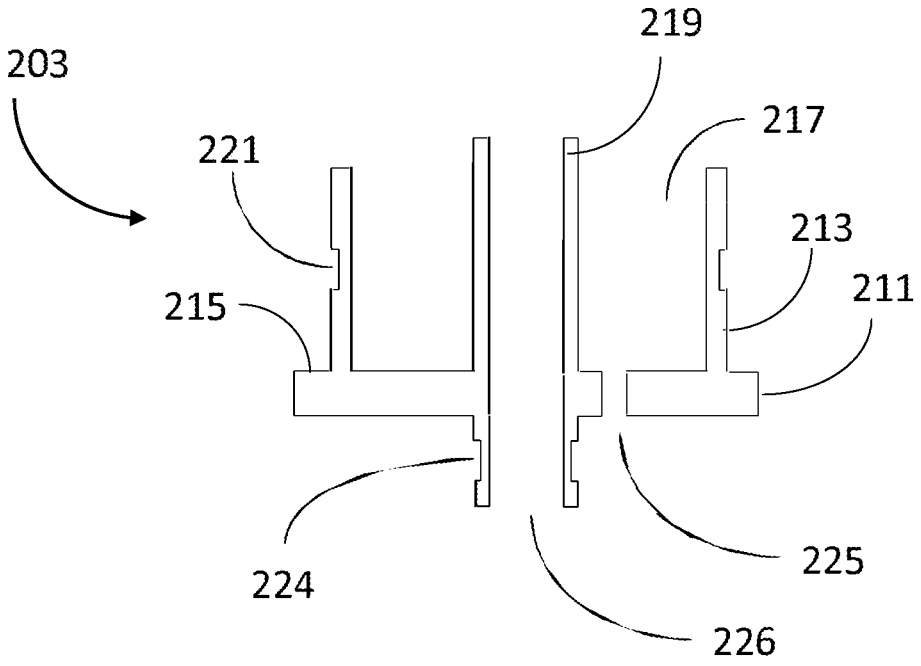
FIG. 4 shows a cross-section through an example of a base that may form part of an apparatus for heating an article comprising aerosolizable medium.

FIG. 4 shows an example of a cross-section through the base 203. The second protuberance 219 includes an airflow path to enable air to enter the heating chamber 201 through the base 203. In one example, the second protuberance 219 is hollow, which enables air to be drawn into the heating chamber 201 through an open end 226 of the base 203. The main body portion 211 of the base 203 includes a slot 225. The slot 225 enables the heater tail 209 to pass through the base 203 to connect the heating element to the control circuitry and/or the power supply. It will be appreciated that such a slot could be provided instead at a different location, for example, in a side wall of the base 203. As shown in FIG. 4, the main body portion 211 and the first protuberance 213 form a pocket 217 around the second protuberance 219 into which a sealant may be injected. This will be discussed in more detail below.

Figure 5:
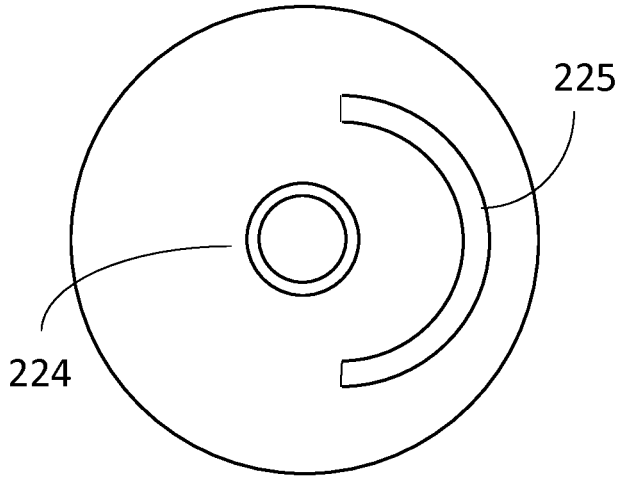
FIGS. 5 and 6 show bottom views of an example of a base that may form part of an apparatus for heating an article comprising aerosolizable medium.
Figure 6:
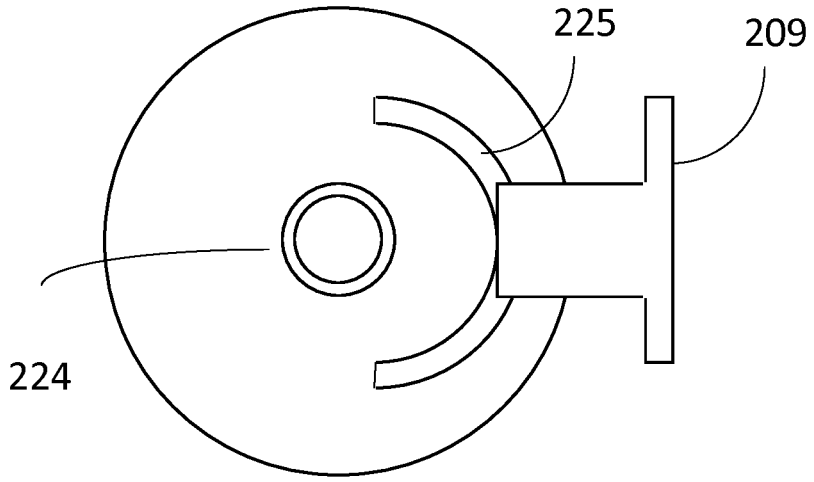

FIG. 5 shows a bottom view of the base 203. The slot 225 is shown as being semi-circular in configuration, but it may be shaped differently. FIG. 6 shows the heater tail 209 passing through the slot 225 in the base 203. The base 203 may be molded from a thermoplastic material, such as polyether ether ketone (PEEK). However, any other suitable material could be used as an alternative.

In one example, a sealant is applied to the base 203 after the heating chamber 201 has been placed on the second protuberance 219 of the base 203 and the heating tail 209 has been extended through the slot 225. The sealant may be injected into the pocket 217 between the main body portion 211 and the first protuberance 213, and the second protuberance 219. The sealant helps to fix the heating chamber 201 and heating tail 209 in place relative to the base 203. Additionally, the sealant acts to fill the remaining space in the slot 225 that isn't taken up by the heating tail 209, which serves to prevent airflow through the slot 225 in the base 203. In one example, the sealant is a potting epoxy resin but any suitable alternative sealant can be used. The sealant may be cured by the application of UV light.

Figure 7:
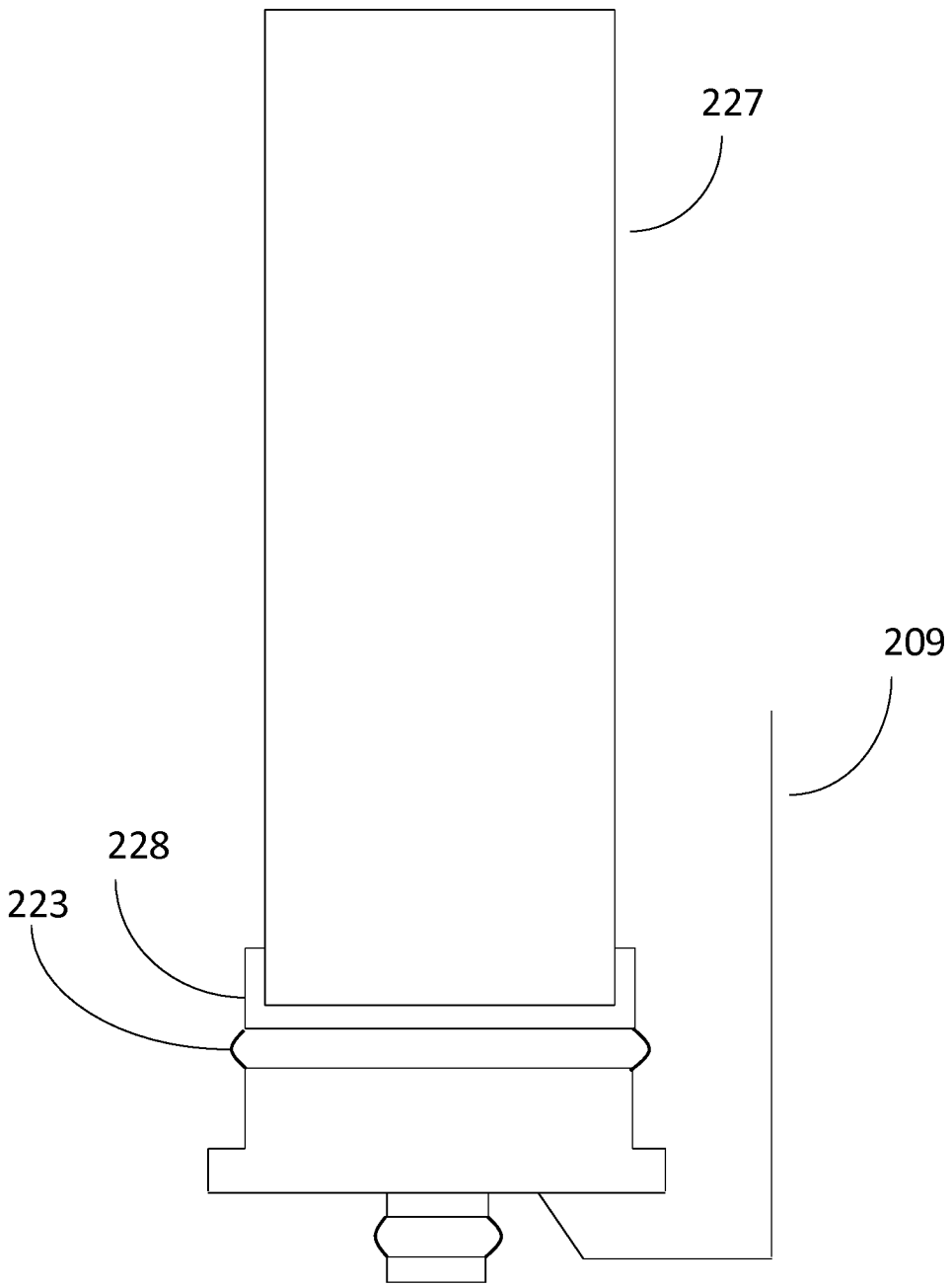
FIG. 7 shows a side view of an example of an insulator and a base that may form part of an apparatus for heating an aerosolizable medium.

FIG. 7 shows an example of an insulator 227 that forms part of an apparatus 300 for heating an aerosolizable medium. The insulator 227 sits within a retaining portion 228 of the base 203 which is arranged above the recess 221. The retaining portion 228 supports the insulator 227 at one end and serves to retain it in position relative to the base 203. In the example shown in FIG. 7, the insulator 227 surrounds at least part of the heating chamber 201. The insulator 227 helps to reduce heat passing from the heating chamber 201 to the exterior of the device 100, which helps to keep down the power requirements for the heating chamber 201 as it reduces heat losses generally. The insulator 227 also helps to keep the exterior of the device 100 cool during operation of the device 100. In one example, the insulator 227 may be a double-walled sleeve which provides a low pressure region between the two walls of the sleeve. That is, the insulator 227 may be for example a "vacuum" tube, i.e. a tube that has been at least partially evacuated so as to minimize heat transfer by conduction and/or convection. Other arrangements for the insulator 227 are possible, including using heat insulating materials, including for example a suitable foam-type material, in addition to or instead of a double-walled sleeve. In one example, the insulator 227 comprises at least one attachment element (not shown) to hold the insulator 227 in position on the base 203.

Figure 8:
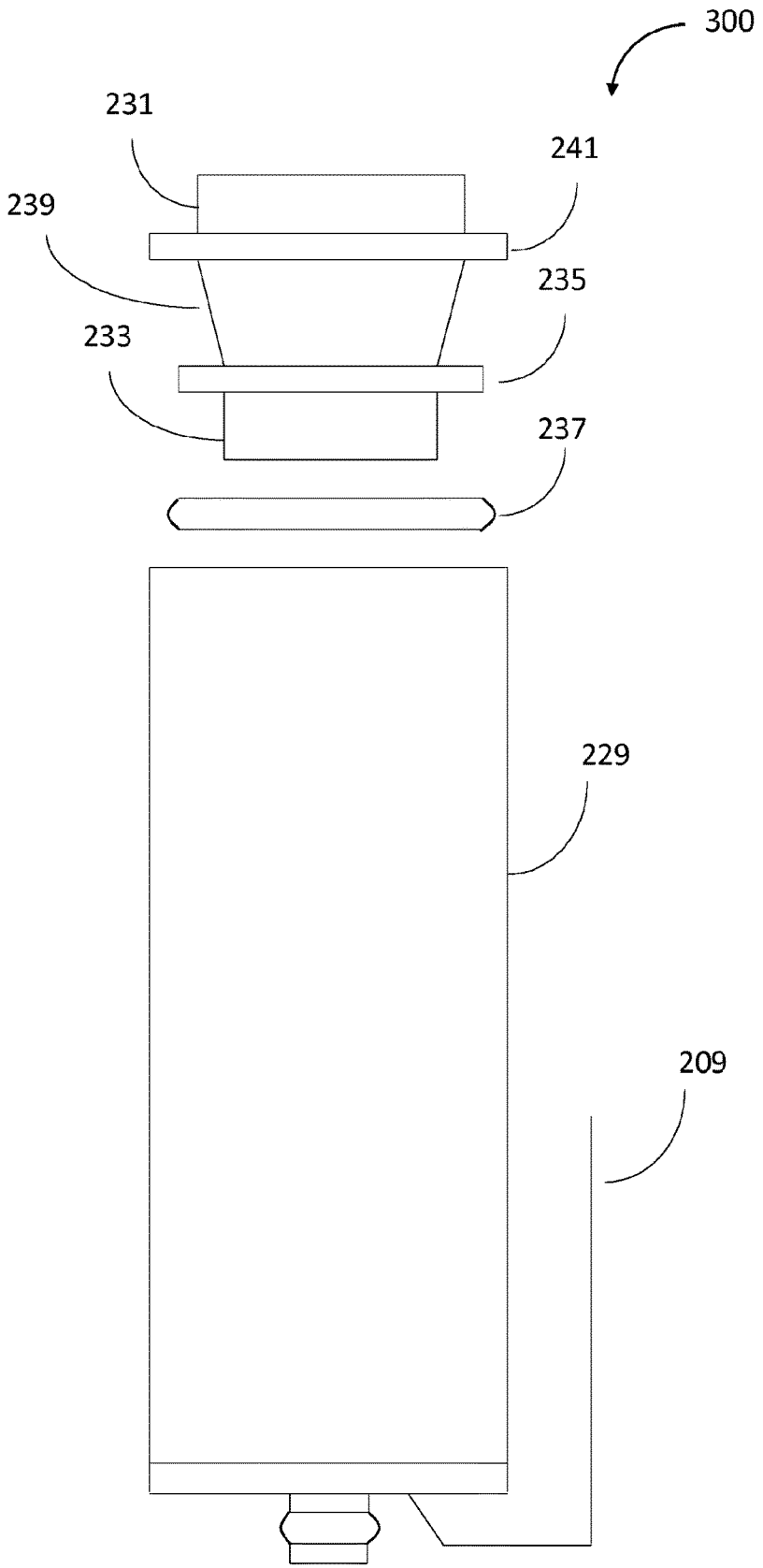
FIGS. 8 and 9 show side views of examples of part of an apparatus for heating an article comprising an aerosolizable medium.
Figure 9:
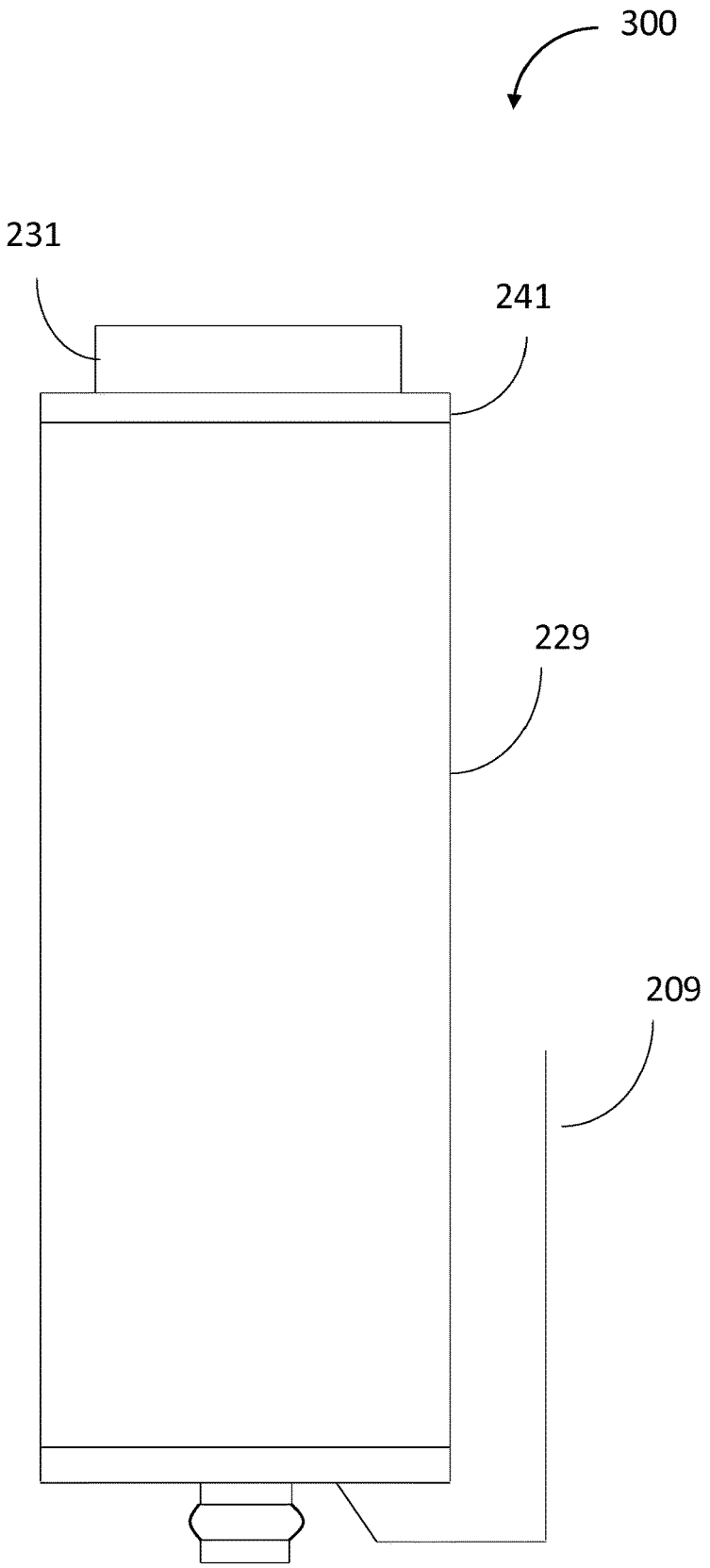

FIGS. 8 and 9 show an example of an apparatus 300 for heating an article 106 comprising an aerosolizable medium. FIG. 8 shows the apparatus 300 with a top 231 removed from a sleeve 229 and FIG. 9 shows an example of the apparatus 300 in which the top 231 has been inserted in the sleeve 229. The sleeve 229 is located around the heating chamber 201 and the sleeve 229 and the heating chamber 201 define a region therebetween. In one example, the heating chamber 201 and the sleeve 229 are co-axial. Where there is an insulator 227, as described above with reference to FIG. 7, the insulator 227 is arranged between the sleeve 229 and the heating chamber 201. A first end of the sleeve 229 may be located on the flange 215 of the base 203 such that the first protuberance 213 of the base 203 is inserted into the first end of the sleeve 229. In one example, the sleeve 229 is a hollow, cylindrical tube that may be extruded. The cylindrical tube may be made of aluminum or a similar material. The sleeve 229 is configured to receive the first seal 223 at a first end of the sleeve 229. The first seal 223 may be received in the vicinity of the first end of the sleeve 229. Preferably, the first seal 223 is not located at the extreme end of the sleeve 229 such that there is a distance between the extreme end of the sleeve 229 and the first seal 223. In some examples, the first seal 223 is provided between the first protuberance 213 and an inner surface of the sleeve 229.

In the example shown in FIG. 8, the thickness of the wall of the sleeve is equal to the width of the flange 215 such that an outside surface of the main body portion 211 of the base is flush with an outside surface of the sleeve 229. The first seal 223 (as shown in FIG. 7) abuts the inside surface of the sleeve 229 such that substantially no air, aerosol or any fluid may flow past the first seal 223. As such, the first seal 223 is configured to prevent ingress or egress of fluid into or out of the region defined by the heating chamber 201 and the sleeve 229. The seal 223 may act to hold the sleeve 229 in place relative to the base 203 and the heating chamber 201. In one example, the first seal 223 is an O-ring, which enables the apparatus 300 to be assembled and disassembled relatively easily without the need for a permanent seal to be applied. Providing the first seal 223 between the first protuberance 213 that projects into the sleeve 229 and the inside surface of the sleeve 229 prevents aerosol from flowing into or out of the sleeve 229, whilst also minimizing the overall size of the apparatus 300. As aerosol is prevented from flowing out of the sleeve 229, the aerosol will be prevented from flowing into the electronics compartment of the device 100.

The sleeve 229 may have an external diameter of between 10 mm and 20 mm, more preferably between 13 mm and 17 mm, or more preferably 14.5 mm and 15 mm. The sleeve may have an internal diameter of between 11 mm and 19 mm, more preferably between 13.5 mm and 16.5 mm and more preferably between 14.0 mm and 14.5 mm. The length of the sleeve may be between 20 mm and 200 mm, more preferably between 55 mm and 75 mm. The sleeve 229 may be formed of a metal material, such as stainless steel but any other suitable material could be used as an alternative.

FIG. 8 also shows a top 231 of the sleeve in the form of a hollow chamber. In one example, the top 231 is formed of regions of varying diameters so that it tapers from a first end to a second end. A first region 233 of the top 231 may be of a relatively smaller diameter compared with the diameter of remaining regions of the top 231. In one example the first region 233 may be inserted into the second end of the sleeve 229. An end of the first region 233 may abut the heating chamber 201. The sleeve 229 is configured to receive a second seal 237 at the second end of the sleeve 229. The second seal 237 may be received in the vicinity of the second end of the sleeve 229. Preferably, the second seal 237 is not located at the extreme end of the sleeve 229 such that there is a distance between the extreme end of the sleeve 229 and the second seal 237. In some examples, the second seal 237 is provided between the first region 223 and an inner surface of the sleeve 229. It will be appreciated that the top 231 could have a uniform diameter along its length.

In one example, the top 231 may include a ring or lip 235 surrounding the first region 233 on which the second seal 237 is located. The top 231 may also include a second region 239 in the shape of a hollow truncated cone. In the example shown, at one end of the second region 239 there is a shoulder 241 of greater diameter than that of the second region 239 at its widest point. The shoulder 241 has a diameter larger than the internal diameter of the sleeve 229 such that, in use, the shoulder 241 abuts the second end of the sleeve 229. The second seal 237 may be located on the ring 235 and abut the inside surface of the sleeve 229. The second seal 237 is configured such that substantially no air, aerosol or other fluid may flow past the seal. As such, the second seal 227 is configured to prevent ingress or egress of fluid into or out of the region defined by the heating chamber 201 and the sleeve 229. Further, the second seal 237 may act to hold the top 231 in place relative to the sleeve 229. In one example, the second seal 237 is an O-ring.

As shown in FIG. 9, when the sleeve 229 is located around the heating chamber 201, with the top 231 and base 203 sealingly engaged with the sleeve 229, a closed unit is provided with only a portion of the heating tail 209 extending from the unit for connection with the control circuitry and/or power supply. Air can enter the base through the connection element 224 so that it passes through the second protuberance 219 and exits the closed unit through the top 231 but no fluid can enter or exit the closed unit through any other route. The closed unit can be used as a sub-assembly for easy incorporation in a device 100 during manufacture.

In use, an article 106 comprising an aerosolizable medium is inserted into the device 100 and into the heating chamber 201 of the apparatus 300. A user may activate the button 108 on the device 100 to operate the one or more heating elements, which in turn heats the heating chamber 201 and generates an aerosol from the aerosolizable medium. Air may be drawn into the heating chamber 201 through the open end of the base 203 and through the second protuberance 219 of the base. Air drawn into the heating chamber 201 passes into the article 106 comprising an aerosolizable medium. The air may pass through the aerosolizable medium and pick up volatilized components released from the aerosolizable medium upon heating, and then the volatilized components, typically in the form of vapor or an aerosol would pass out of the article 106 to a user. In this example, the airflow path is formed through the base 203, the heating chamber 201 and the top 231.

As the heating chamber 201 may not be completely air-tight, some of the generated aerosol may flow between the heating chamber 201 and the sleeve 229. However, since the first seal 223, the second seal 237, the heating chamber 201 and the sleeve 229 together form an enclosed region, any generated aerosol that flows from the heating chamber 201 into the sleeve 229 will be kept within the sleeve 229 and prevented from flowing elsewhere in the device, including into any electronics compartment, power supply and/or control circuitry. The sleeve 229, first seal 223 and the second seal 237 effectively act to isolate the heating chamber 201 from the electronics compartment within the device 100. The first seal 223 and the second seal 237 also prevent the flow of air into the sleeve 229 outside of the desired flow path discussed above.

Testing has demonstrated a reduction in condensates in an apparatus including the first seal 229 and second seal 237 compared with an apparatus that does not include these seals. Initially, each apparatus was pressure checked at 1 PSI (0.068 bar). A bubble check solution was applied around the first seal 223 and the second seal 237 to check for leaks. The apparatus was then operated to heat twenty articles 106 comprising an aerosolizable medium. Following the heating, the apparatus was deconstructed, and a visual inspection confirmed that a noticeable condensate was present within the second protuberance 219 and also within the top 231. However, no condensate was present on the inside surface of the sleeve 229 or within the electronics compartment.

Figure 10:
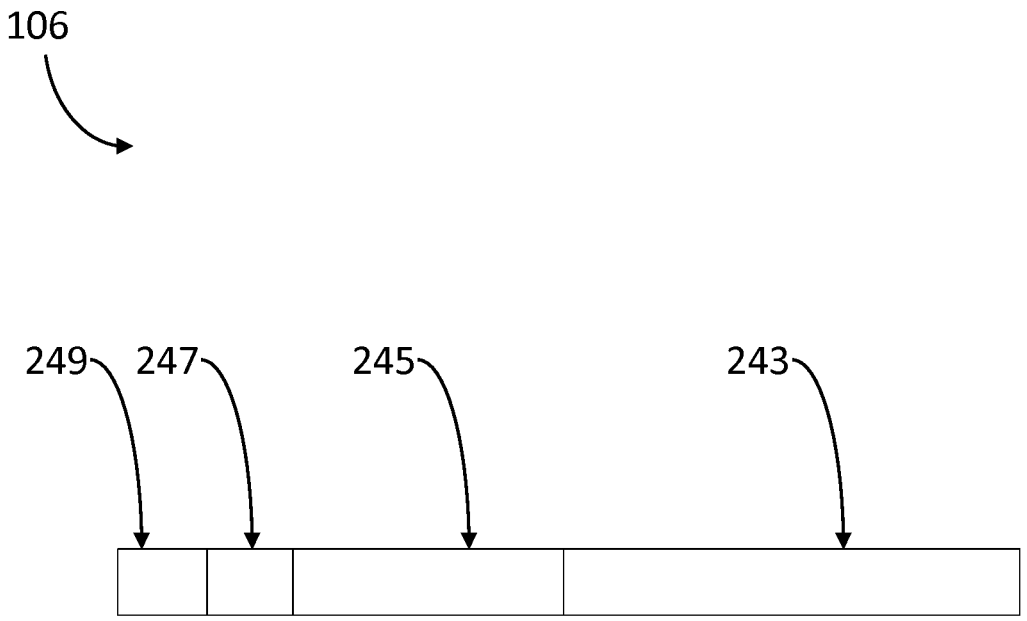
FIG. 10 shows a cross-section of an example of an article comprising an aerosolizable medium.

Referring to FIG. 10, there is shown a schematic cross-sectional view of an article 106 comprising an aerosolizable medium according to an example of the invention. The article 106 of this embodiment is particularly suitable for use with the apparatus 300 shown in FIG. 9. In use, the article 106 may be removably inserted into the heating chamber 201 through an opening in the top 231. The article 106 will abut the second protuberance 219 of the base 203 within the heating chamber 203 at one end.

In one embodiment, the article 106 includes a body of aerosolizable medium 243 and a filter assembly combined in the form of a rod. The filter assembly of this embodiment comprises three segments: a cooling segment 245; a filter segment 247; and a mouth end segment 249. However, in other embodiments any one or two or all of these segments 245, 247, 249 may be omitted.

The body of aerosolizable medium 243 is located towards a distal end of the article 106, i.e. an end furthermost from a user's mouth, in use. In one embodiment, the cooling segment 245 is located between the body of aerosolizable medium 243 and the filter segment 247, such that the cooling segment 245 is in an abutting relationship with the aerosolizable medium 243 and the filter segment 247. The filter segment 247 is located between the cooling segment 245 and the mouth end segment 249. The mouth end segment 249 is located towards a proximal end of the article 106 (i.e. an end closest to the user in use), adjacent the filter segment 247. In one embodiment, the filter segment 247 is in an abutting relationship with the mouth end segment 249.

In the examples described above, the base 203 and the top 231 are shown as protruding into the sleeve 229, but in other examples, the base 203 and/or the top 231 may be connected to the sleeve 229 via other means, such as a push-fit around the sleeve.

As used herein, the term "aerosolizable medium" includes materials that provide volatilized components upon heating, typically in the form of vapor or an aerosol. "Aerosolizable medium" may be a non-tobacco-containing material or a tobacco-containing material. "Aerosolizable medium" may, for example, include one or more of tobacco per se, tobacco derivatives, expanded tobacco, reconstituted tobacco, tobacco extract, homogenized tobacco or tobacco substitutes. The aerosolizable medium can be in the form of ground tobacco, cut rag tobacco, extruded tobacco, reconstituted tobacco, reconstituted smokable material, liquid, gel, gelled sheet, powder, or agglomerates, or the like. Aerosolizable medium also may include other, non-tobacco, products, which, depending on the product, may or may not contain nicotine. Aerosolizable medium may comprise one or more humectants, such as glycerol or propylene glycol. In one embodiment, the body of aerosolizable medium 243 comprises tobacco. The article 106 may comprise one or more flavorants.

As used herein, the terms "flavor" and "flavorant" refer to materials which, where local regulations permit, may be used to create a desired taste or aroma in a product for adult consumers. They may include extracts (e.g., licorice, hydrangea, Japanese white bark magnolia leaf, chamomile, fenugreek, clove, menthol, Japanese mint, aniseed, cinnamon, herb, wintergreen, cherry, berry, peach, apple, Drambuie, bourbon, scotch, whiskey, spearmint, peppermint, lavender, cardamom, celery, cascarilla, nutmeg, sandalwood, bergamot, geranium, honey essence, rose oil, vanilla, lemon oil, orange oil, cassia, caraway, cognac, jasmine, ylang-ylang, sage, fennel, piment, ginger, anise, coriander, coffee, or a mint oil from any species of the genus Mentha), flavor enhancers, bitterness receptor site blockers, sensorial receptor site activators or stimulators, sugars and/or sugar substitutes (e.g., sucralose, acesulfame potassium, aspartame, saccharine, cyclamates, lactose, sucrose, glucose, fructose, sorbitol, or mannitol), and other additives such as charcoal, chlorophyll, minerals, botanicals, or breath freshening agents. They may be imitation, synthetic or natural ingredients or blends thereof. They may comprise natural or nature-identical aroma chemicals. They may be in any suitable form, for example, oil, liquid, powder, or gel.

In one embodiment, the article 106 is elongate and substantially cylindrical with a substantially circular cross-section. However, in other embodiments, the article 106 may have a cross-section other than circular and/or not be elongate and/or not be cylindrical. The aerosolizable material article 106 may be used with the apparatus 300.

The apparatus 300 may be manufactured by providing a base 203 which includes a first projection 213 and a second projection 219. The heating chamber 201 may then be located on the second projection 219, for example by sliding the heating chamber 201 onto the base 203. A heater tail 209 may be passed through a slot 225 in the base 203 to permit connection of a heating element inside the heating chamber to control circuitry and/or a power supply outside the chamber. In some examples, a sealant is provided, for example by being injected, to seal the heating chamber 201 to the base 203. Where this is the case, it is preferable to apply the sealant before the sleeve 229 is arranged on the second projection 219. In one example, the sealant is cured by the application of a UV light. In some examples, the base 203 is held in place by a fixture and may be removed from the fixture after the application of the sealant. An insulator 227 may be provided over the heating chamber 201 and part of the base 203, and attached thereto. A sleeve 229 may be received on the second projection 219 of the base 203 so that it abuts the flange 215. A top 231 may then be inserted in the second end of the sleeve 229. A first seal 223 may be included within the sleeve 229 at the first end of the sleeve 229 and a second seal may be received in the sleeve at the second end of the sleeve 229, or alternatively on the base 203 or top 231, respectively, in a region at which the base 203 and top 231 engage with the sleeve 229. In some examples, the first seal 223 is located on the second projection 219 of the base 203 and the second seal 237 is located on a ring 235 on the top 231. Providing a closed system including the heating chamber 201 as a separate entity reduces the complexity of the device manufacture overall.

The apparatus 300 and the aerosolizable material article 106 form a system that may be sold as a pack.

The above embodiments are to be understood as illustrative examples of the invention. Further embodiments of the invention are envisaged. It is to be understood that any feature described in relation to any one embodiment may be used alone, or in combination with other features described, and may also be used in combination with one or more features of any other of the embodiments, or any combination of any other of the embodiments. Furthermore, equivalents and modifications not described above may also be employed without departing from the scope of the invention, which is defined in the accompanying claims.

The invention claimed is:

1. A system comprising:

an article comprising a solid aerosolizable material; and a heat-not-burn (HNB) apparatus for heating the article, the apparatus comprising:

a housing;

a heating chamber within the housing for receiving said article; and a sleeve located around the heating chamber, wherein the heating chamber and the sleeve define a region therebetween, wherein the sleeve is configured to receive a first seal at a first end of the sleeve and a second seal at a second end of the sleeve, so that the sleeve can engage with additional components at the first and second ends in such a way that ingress of fluid into or egress of fluid out of the region between the heating chamber and the sleeve is prevented;

wherein the heating chamber is a tube, wherein the tube is itself a heating element.

2. The system according to claim 1, wherein the apparatus further comprises a base at the first end of the sleeve, the base being sealingly engaged with the sleeve at the first end.

3. The system according to claim 2, wherein the base comprises a first projection which protrudes into the sleeve at the first end.

4. The system according to claim 3, wherein the first seal is arranged between the first projection and an inner surface of the sleeve.

5. The system according to claim 4, wherein the first seal is provided around a periphery of the first projection.

6. The system according to claim 4, wherein the first seal is an O-ring.

7. The system according to claim 4, wherein the base comprises a recess for receiving the first seal.

8. The system according to claim 2, wherein the base further comprises a second projection that protrudes into a first end of the heating chamber.

9. The system according to claim 8, wherein the second projection is located substantially centrally on the base.

10. The system according to claim 8, wherein the second projection is configured to receive the heating chamber.

11. The system according to claim 2, wherein the base is made from polyether ether ketone (PEEK).

12. The system according to claim 2, further comprising a sealant applied to the base to seal the heating chamber to the base.

13. The system according to claim 12, wherein the sealant is an epoxy resin.

14. The system according to claim 2, further comprising a heater tail connected to the heating chamber, wherein the heater tail is configured to connect to a power source to provide power to the heating chamber.

15. The system according to claim 14, wherein the tail extends through a slot in the base for connection to the power source.

16. The system according to claim 1, further comprising a top at the second end of the sleeve, the top being sealingly engaged with the sleeve at the second end.

17. The system according to claim 16, wherein the second seal is an O-ring.

18. The system according to claim 16, wherein the top comprises a recess for receiving the second seal.

19. The system according to claim 16, wherein the top comprises a hollow chamber.

20. The system according to claim 1, further comprising an insulator for insulating the heating chamber.

21. The system according to claim 20, wherein the insulator is located between the heating chamber and the sleeve.

22. The system according to claim 21, wherein the insulator comprises vacuum insulation.

23. The system according to claim 1, wherein the sleeve is made from stainless steel.

24. A method of manufacturing a system comprising an article including a solid aerosolizable material and a heat-not-burn (HNB) apparatus for heating the article, the method comprising:

providing the article;

providing a housing as part of the HNB apparatus;

providing a heating chamber within the HNB apparatus; and providing a sleeve around the heating chamber, the sleeve comprising a first end and a second end, wherein the heating chamber and the sleeve define a region therebetween, wherein the sleeve is configured to receive a first seal at the first end of the sleeve and a second seal at the second end of the sleeve, so that the sleeve can engage with additional components at the first and second ends in such a way that ingress of fluid into or egress of fluid out of the region between the heating chamber and the sleeve into or out of the region between the heating chamber and the sleeve is prevented;

wherein the heating chamber is a tube, wherein the tube is itself a heating element.

25. The method of manufacturing according to claim 24, further comprising:

providing a base comprising a first projection and a second projection, wherein the sleeve is received on the first projection and the heating chamber is received on the second projection;

providing a sealant to seal the heating chamber to the base;

providing a first seal on the base; and providing a top at the second end of the sleeve, and a second seal on the top.

* * * * *